US005482444A

United States Patent [19]

Coha et al.

[11] Patent Number: 5,482,444

[45] Date of Patent: Jan. 9, 1996

[54] VIBRATION ISOLATING MOUNTING FOR AN ELECTRIC FUEL PUMP

[75] Inventors: Timothy F. Coha, Burton; Ulf Sawert, Grand Blanc, both of Mich.

[73] Assignee: General Motors Corporation, Detroit, Mich.

[21] Appl. No.: 417,175

[22] Filed: Apr. 5, 1995

Related U.S. Application Data

[63] Continuation-in-part of Ser. No. 301,446, Sep. 6, 1994, abandoned.

[51] Int. Cl.[6] ..... F04B 53/16

[52] U.S. Cl. ..... 417/363; 248/638

[58] Field of Search ..... 417/363, 360; 137/590; 248/603, 604, 638

[56] References Cited

U.S. PATENT DOCUMENTS

| | | | |
|---|---|---|---|
| 3,910,464 | 10/1975 | Schlanzky . | |
| 4,306,844 | 12/1981 | Oho et al. | 417/360 |
| 4,309,155 | 1/1982 | Heinz et al. | 417/360 |
| 4,590,964 | 5/1986 | Beardmore . | |
| 4,591,319 | 5/1986 | Takahashi et al. | 417/360 |
| 4,780,063 | 10/1988 | Tuckey | 137/590 |
| 4,948,346 | 8/1990 | Tuckey . | |
| 4,961,693 | 10/1990 | Hoover et al. . | |
| 4,964,787 | 10/1990 | Hoover . | |
| 5,002,467 | 3/1991 | Talaski et al. . | |
| 5,020,978 | 6/1991 | Nashif . | |
| 5,165,867 | 11/1992 | Dockery . | |

FOREIGN PATENT DOCUMENTS

| | | | |
|---|---|---|---|
| 2750081 | 5/1979 | Germany | 137/590 |

*Primary Examiner*—Timothy S. Thorpe
*Assistant Examiner*—Roland G. McAndrews, Jr.
*Attorney, Agent, or Firm*—Saul Schwartz

[57] ABSTRACT

A vibration isolating mounting for an electric fuel pump on a plastic retainer of a reservoir in a motor vehicle fuel tank includes a tubular wall on the plastic retainer and a plurality of elastic tubes squeezed between the tubular wall and the fuel pump to support the fuel pump on the tubular wall in radial static equilibrium. In a first preferred embodiment, the elastic tubes are formed integrally with an elastic sleeve fitted over the fuel pump. In a second preferred embodiment, each of the elastic tubes has a pair of diametrically opposite integral radial webs closely received in vertical slots in the tubular wall and in a tubular inner retainer around the fuel pump.

8 Claims, 4 Drawing Sheets

VIBRATION ISOLATING MOUNTING FOR AN ELECTRIC FUEL PUMP

CROSS REFERENCE TO RELATED APPLICATION

This is a continuation-in-part of U.S. patent application Ser. No. 08/301,446, filed 06 Sep. 1994 and assigned to the assignee of this invention, now abandoned.

FIELD OF THE INVENTION

This invention relates to electric fuel pumps for motor vehicles.

BACKGROUND OF THE INVENTION

U.S. Pat. No. 4,718,827, issued 12 Jan. 1988 and assigned to the assignee of this invention, describes an electric fuel pump for a motor vehicle including a vapor separating pump, a high pressure pump, and an electric motor for driving rotating elements in each pump. Such electric fuel pumps are commonly mounted inside a fuel tank of the vehicle by a clamp on a pipe attached to a panel of the fuel tank as described in U.S. Pat. No. 5,165,867, issued 24 November 1992 and assigned to the assignee of this invention, or on a plastic reservoir in the fuel tank such as described in U.S. Pat. No. 4,945,884, issued 7 Aug. 1990 and assigned to the assignee of this invention. To minimize the transmission of vibrations of the electric fuel pump to the fuel tank, it is known to interpose an elastic isolator of rubber or like material between the pump and either the clamp or the reservoir and, in some embodiments, to form the isolator with monolithic ribs. It is also known to rigidly mount a plastic cage in the fuel tank and to suspend the electric fuel pump inside the cage either by resilient fingers integral with the cage engaging the sides, top and bottom of the pump or by springs between cage and the top and bottom of the pump. A vibration isolating mounting according to this invention is an improvement over the above described fuel pump mounting arrangements.

SUMMARY OF THE INVENTION

This invention is a new and improved vibration isolating mounting for an electric fuel pump on a stationary support in a fuel tank of a motor vehicle. In the mounting according to this invention, a plurality of small diameter elastic tubes are squeezed between the fuel pump and the stationary support in a primary flexure mode perpendicular to the respective longitudinal centerlines of the elastic tubes. The elastic tubes are arrayed around the fuel pump such that the resilient reactions of each on the fuel pump cooperate in suspending the fuel pump relative to the stationary support in radial static equilibrium. Radial vibratory excursions of the fuel pump relative to the stationary support are resiliently resisted by the elastic tubes through further flexure in the primary flexure mode. The performance characteristics of the primary flexure mode are readily customized by material selection and wall thickness adjustment so that the mounting according to this invention is easily adapted for different fuel pump installations. In a first preferred embodiment of the vibration isolating mounting according to this invention, the stationary support is a plastic reservoir in the fuel tank and the small elastic tubes are integral with an elastic sleeve stretched over the fuel pump, the elastic tubes seating in a corresponding plurality of open, vertical channels of the reservoir. In a second preferred embodiment of the vibration isolating mounting according to this invention, the small elastic tubes are discrete elements each having a pair of longitudinal grooves which fit in longitudinal slots in the plastic reservoir and in an inner retainer around the fuel pump.

DESCRIPTION OF A PREFERRED EMBODIMENT

Figure 1:
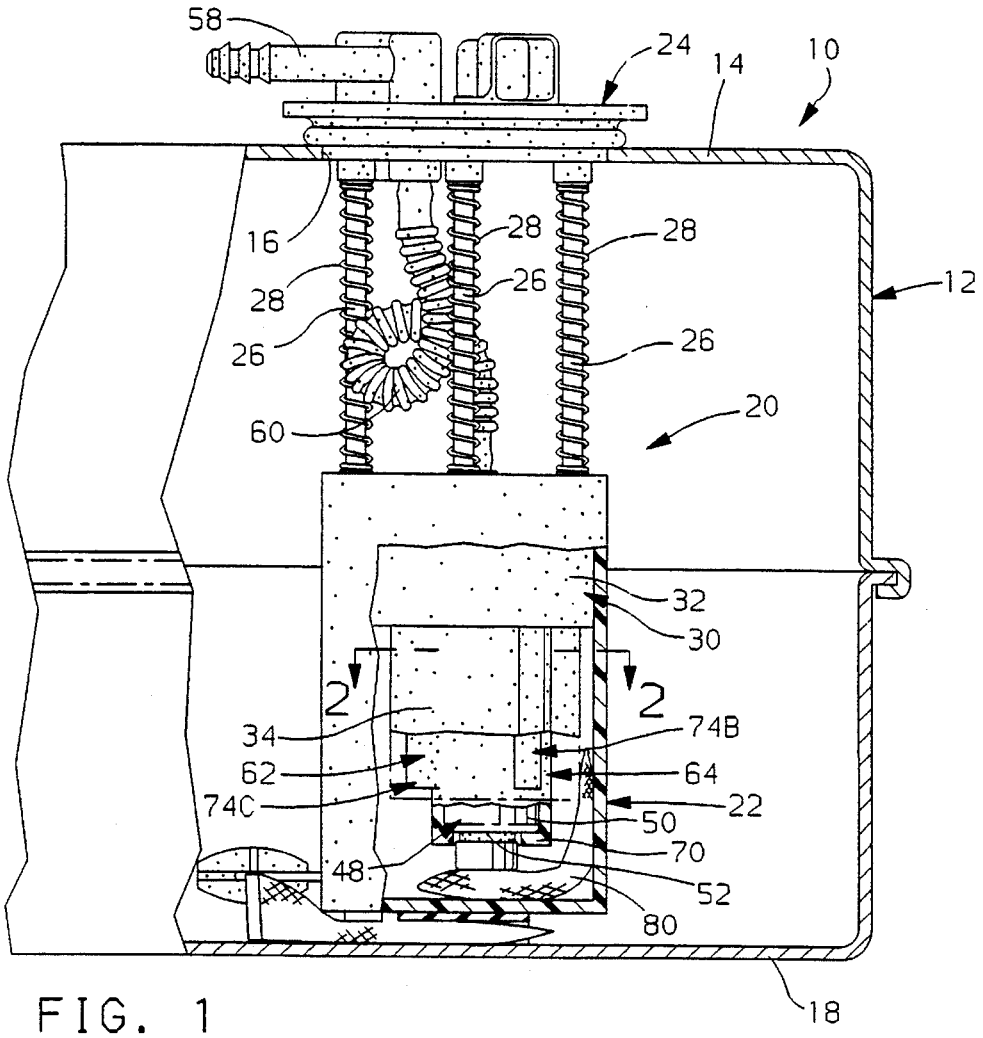
FIG. 1 is a fragmentary, partially brokenaway view of a motor vehicle fuel system having an electric fuel pump and a vibration isolating mounting according to this invention.

As seen best in FIG. 1, a fragmentarily illustrated motor vehicle fuel system 10 includes a fuel tank 12 mounted on a sprung mass or body of the vehicle, not shown. The tank 12 has a top panel 14 with an access opening 16 therein and a bottom panel 18. A modular fuel sender 20 of the fuel system 10, described representatively in the aforesaid U.S. Pat. No. 4,945,884, is installed through the access opening 16 and includes a cup-shaped plastic reservoir 22 and a tank cover 24. A plurality of hollow struts 26 are rigidly fitted in sockets in the tank cover and telescopically received in a corresponding plurality of sockets in the plastic reservoir. A spring 28 around each strut 26 urges relative separation between the tank cover and the plastic reservoir. The tank cover 24 closes the access opening 16 in the top panel of the fuel tank and the springs 28 bias the reservoir against the bottom panel 18.

A plastic retainer 30, FIGS. 1 and 4, fits inside the reservoir 22 and includes a cylindrical body 32 having about the same diameter as the reservoir 22 and an integral, smaller diameter tubular extension 34 below the body. The tubular extension 34 is open from above through a horizontal surface 36 of the body, FIG. 3, and has a vertical centerline 38, FIG. 4. A plurality of vertical channels 40A–C in the tubular extension 34 open inward toward the vertical centerline 38. Each of the channels 40A–C has a pair of converging flat sides 42A–B, is open on top through the horizontal surface 36, and is closed at the bottom by a shoulder 44 of the tubular extension 34. A pair of integral flexible legs 46A–B on the cylindrical body 32 each have a barb 47 thereon which is received in a notch, not shown, in the reservoir 22 to rigidly attach the plastic retainer 30 to the reservoir.

An electric fuel pump 48, such as described representatively in the aforesaid U.S. Pat. No. 4,718,827, includes a cylindrical housing 50, an inlet 52 at one end, and a discharge 54 at the other end. The pump 48 is disposed vertically in the tubular extension 34 of the plastic retainer 30 and protrudes beyond the shoulder 44. The discharge 54 communicates with a connector 58 on the tank cover 24 through a flexible hose 60. The connector 58 communicates with an engine of the motor vehicle through a high pressure conduit, not shown. Excess fuel is returned to the reservoir 22 through another connector on the tank cover and one of the hollow tubular struts 26. The electric fuel pump 48 is supported in the fuel tank 12 on the stationary platform defined by the plastic retainer 30 by a vibration isolating mounting 62 according to this invention.

Figure 2:
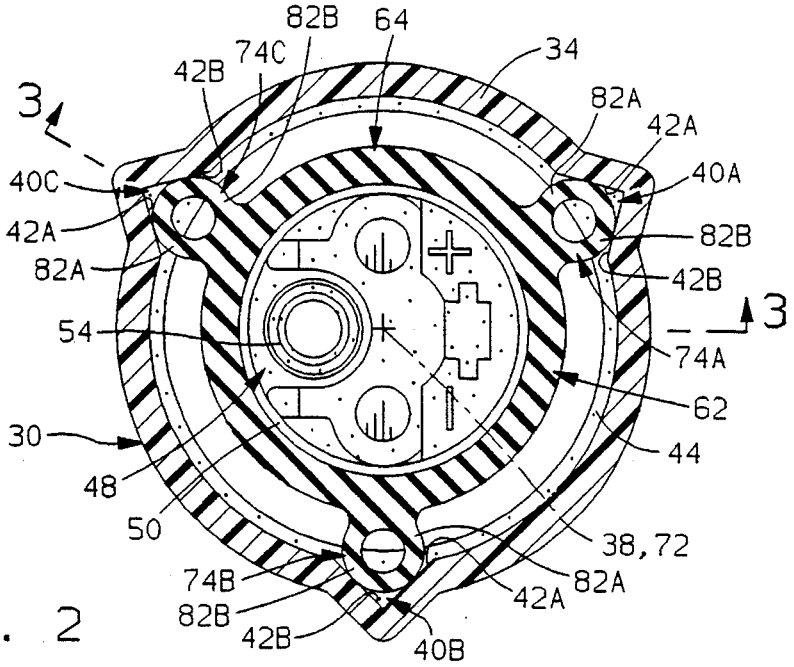
FIG. 2 is a sectional view taken generally along the plane indicated by lines 2—2 in FIG. 1.
Figure 3:
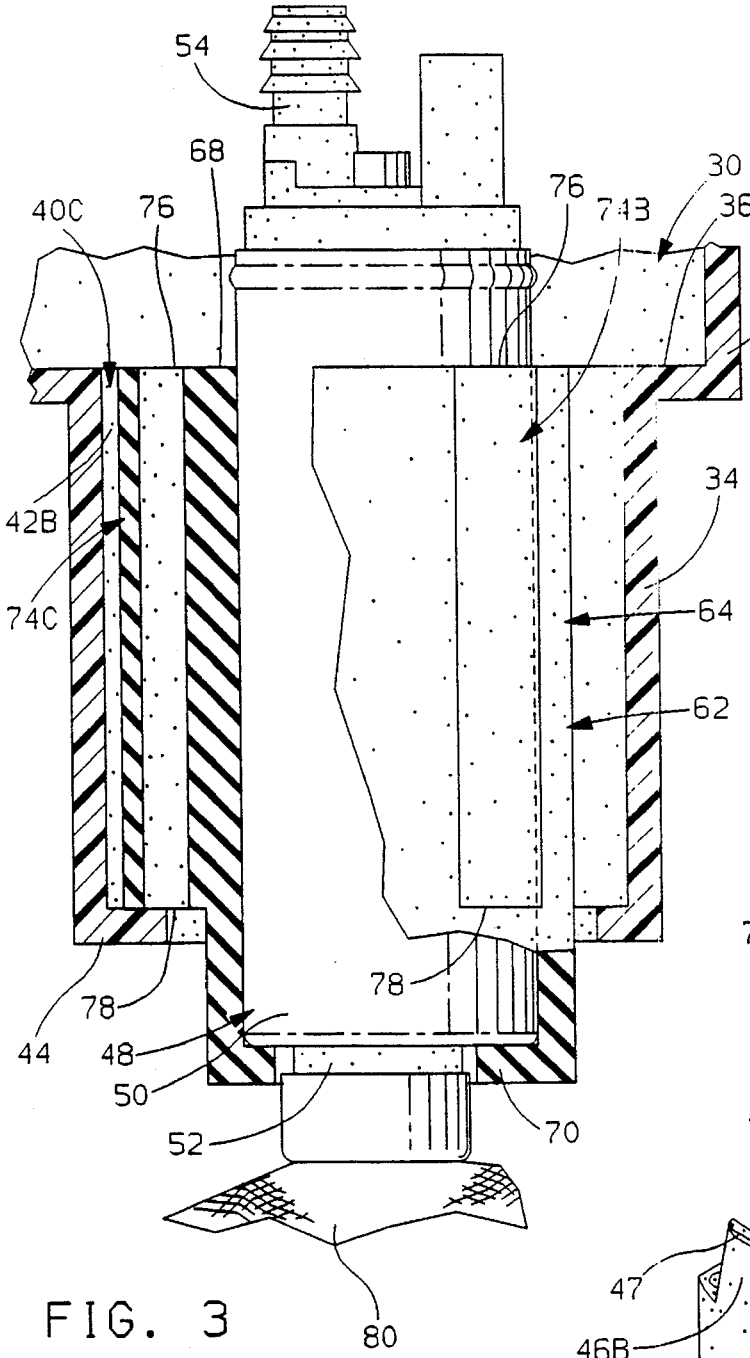
FIG. 3 is a sectional view taken generally along the plane indicated by lines 3—3 in FIG. 2.
Figure 4:
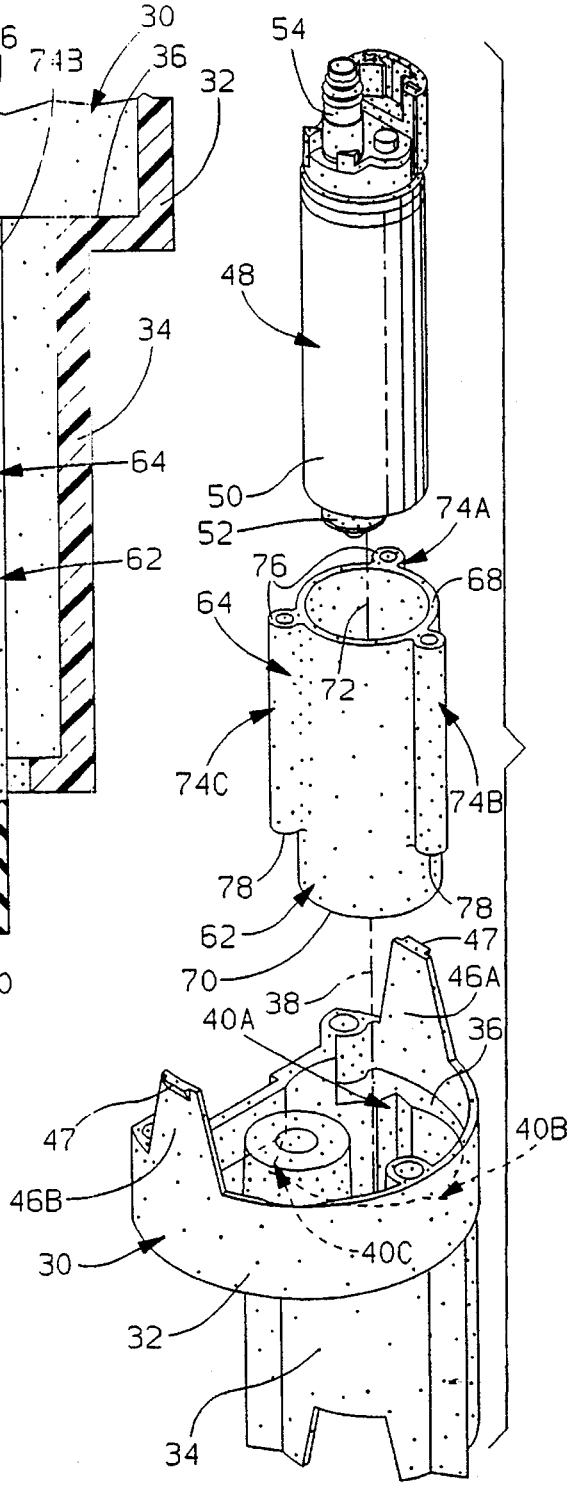
FIG. 4 is a fragmentary exploded perspective view of a portion of FIG. 1.

Referring to FIGS. 2–4, the mounting 62 according to this invention includes an elastic sleeve 64 made of rubber or like material terminating at the top at an edge 68 and at the bottom at an annular lip 70 turned radially inward toward a longitudinal centerline 72, FIG. 4, of the sleeve. The sleeve 64 further includes a plurality of integral small diameter elastic tubes 74A–C each parallel to the centerline 72 and generally tangent to the sleeve. Each of the elastic tubes 74A–C terminates on top at an edge 76 coplanar with the edge 68 of the sleeve and on the bottom at an edge 78 above the plane of the lip 70.

The housing 50 of the fuel pump is inserted into the sleeve 64 until the lip 70 engages the pump housing, FIGS. 1 and 3. The inlet 52 of the pump protrudes through the opening in the sleeve defined by the lip 70. A screen 80, FIGS. 1 and 3, is attached to the inlet on the opposite side of the lip from the pump. The natural or unstretched inside diameter of the sleeve 64 is smaller than the diameter of the housing 50 of the fuel pump so that the sleeve is elastically stretched when fitted over the fuel pump housing.

The fuel pump 48, with the sleeve 64 thereon, is installed in the tubular extension 34 through the open end thereof with each of the elastic tubes 74A–C sliding into a corresponding one of the vertical channels 40A–C and with the centerline 72 of the sleeve coincident with the vertical centerline 38 of the tubular extension. An installed position of the fuel pump in the tubular extension, FIGS. 1 and 3, is defined by engagement of the bottom edges 78 of the elastic tubes 74A–C on the shoulder 44 of the tubular extension. The elastic tubes 74A–C are each parallel to the coincident centerlines 38,72 and generally tangent to corresponding ones of the flat sides 42A–B of the vertical channels.

The diameter of each of the elastic tubes 74A–C is calculated to initially effect interference engagement with the sides 42A–B of the corresponding one of the channels 40A–C so that each elastic tube is squeezed or flexed in a primary flexure mode along its full length, i.e. each of the elastic tubes assumes a generally oval-shaped cross section in a plane perpendicular to the coincident centerlines 38,72, between the fuel pump and the stationary support. The primary flexure mode approximates simple beam bending of the wall of each elastic tube at each of a pair of diametrically opposite nodes 82A–B, FIG. 2. As long as the walls of the elastic tubes do not buckle at the nodes 82A–B, such beam bending induces a plurality of resilient net force reactions between the fuel pump and the stationary support directed radially through the coincident centerlines 38,72 which cooperate in suspending the fuel pump in radial static equilibrium equidistant from each of the channels 40A–C.

When the electric motor of the fuel pump 48 is on, radial vibratory excursions of the fuel pump perpendicular to the coincident centerlines 38,72 are resiliently resisted, i.e. isolated from the stationary support, by the elastic tubes 74A–C in the primary flexure mode through additional beam bending of the walls of the tubes at the nodes 82A–B. Nonradial excursions of the fuel pump relative to the stationary support are resiliently resisted by the elastic tubes 74A–C in a secondary flexure mode characterized by twisting and/or stretching of the tubes within the elastic limit of the material from which the sleeve 64 and the integral elastic tubes are made.

Figure 5:
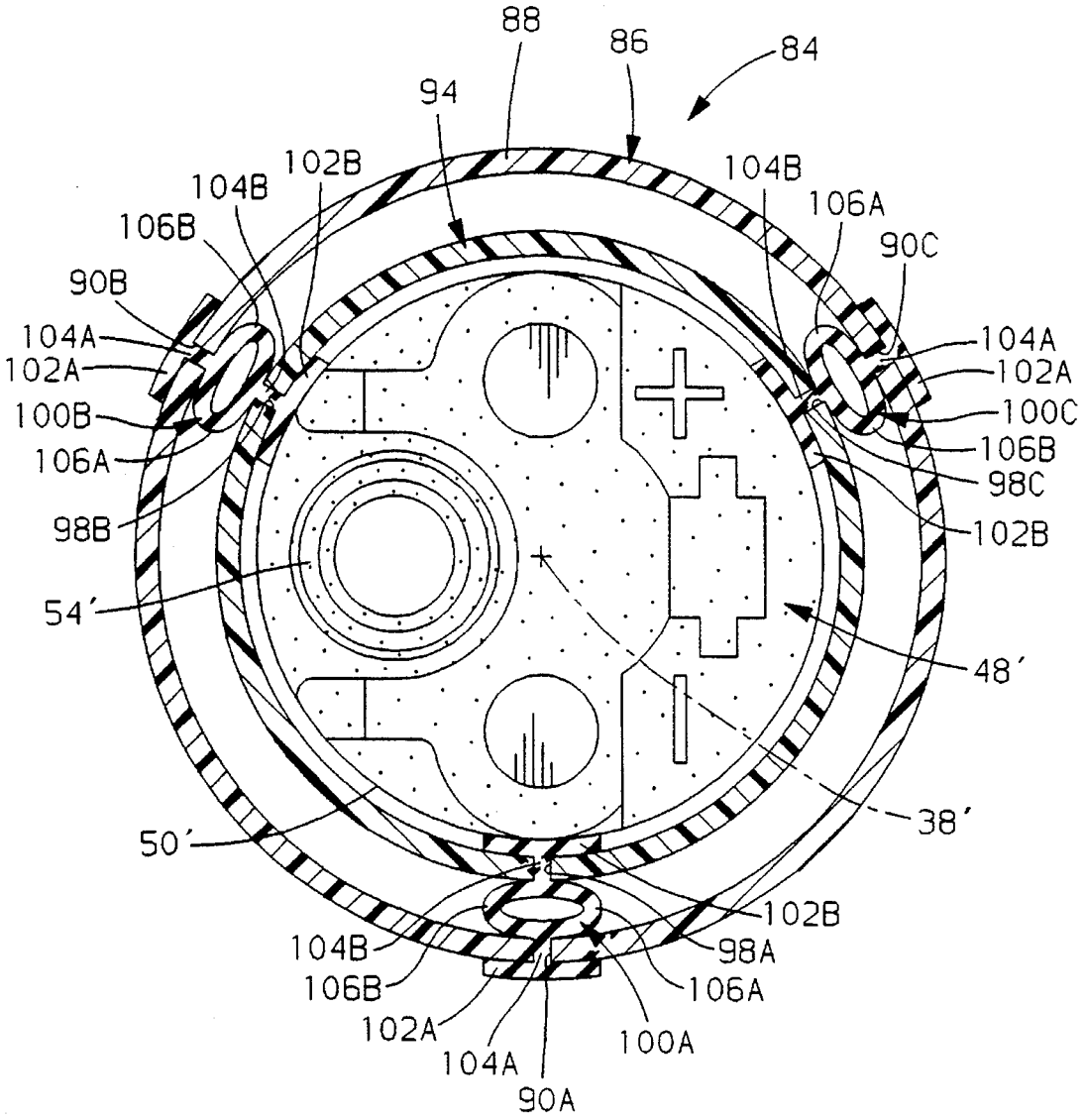
FIG. 5 is similar to FIG. 2 but illustrating a second preferred embodiment of the vibration isolating mounting according to this invention.
Figure 6:
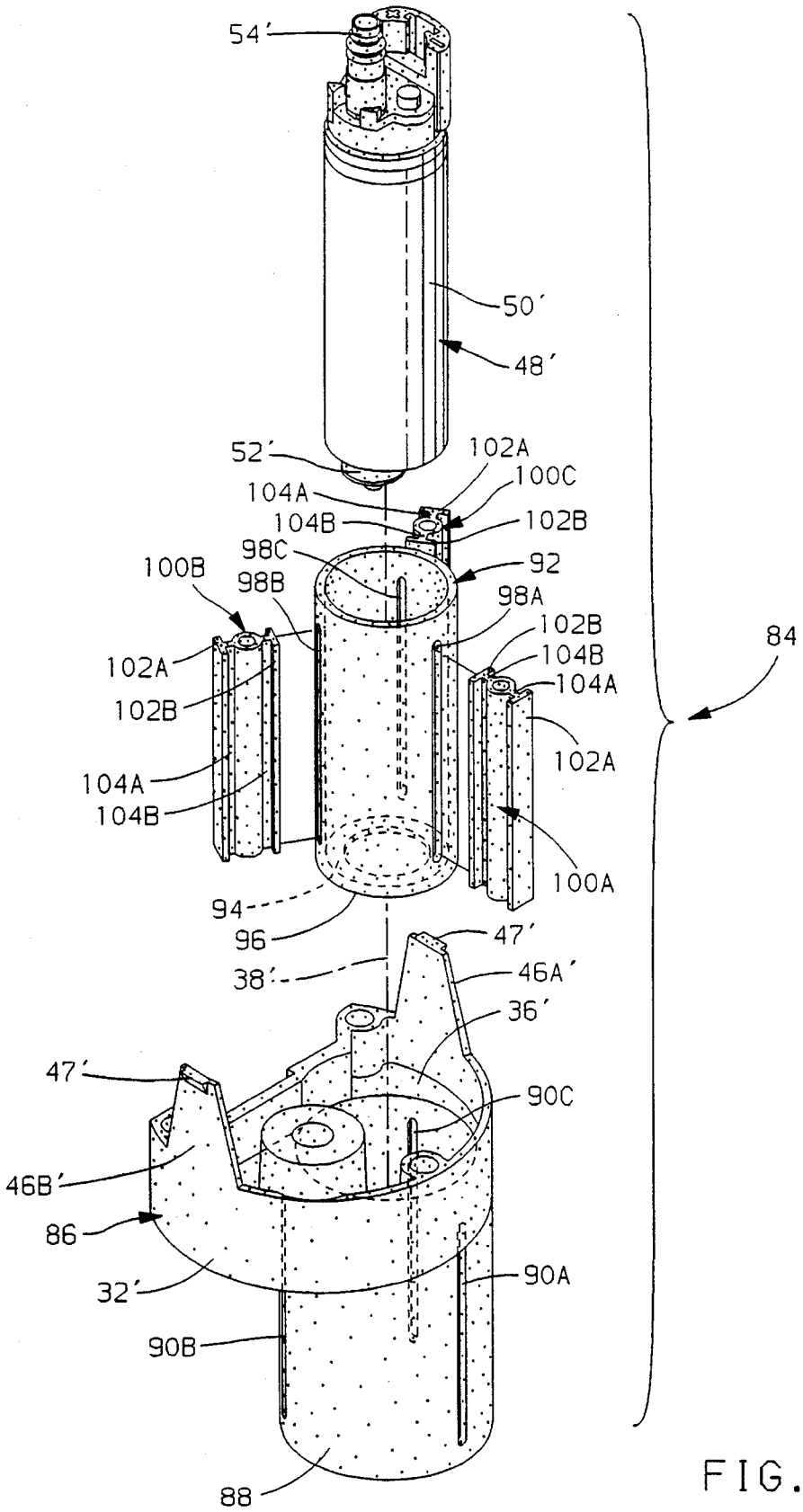
FIG. 6 is similar to FIG. 4 but illustrating the second preferred embodiment of the vibration isolating mounting according to this invention.

A second preferred embodiment 84 of the fuel pump mounting according to this invention is illustrated in FIGS. 5–6 wherein structural elements common to the first and second preferred embodiments 62,84, respectively, are identified with primed reference characters. A modified plastic retainer 86, corresponding to the plastic retainer 30 described above, fits inside the reservoir 22 and includes a cylindrical body 32' having about the same diameter as the reservoir 22 and an integral, smaller diameter tubular extension 88 below the body. The tubular extension 88 is open from above through a horizontal surface 36' of the body and from below. The tubular extension 88 has a vertical centerline 38', FIG. 6, and a plurality of vertical slots 90A–C evenly angularly spaced therearound. A pair of integral flexible legs 46A'–B' on the cylindrical body 32' each have a barb 47' thereon which is received in a notch, not shown, in the reservoir 22 to rigidly attach the plastic retainer 86 to the reservoir.

A tubular inner retainer 92 having a smaller diameter than the tubular extension 88 fits in the tubular extension through the horizontal surface 36' on the plastic retainer. The inner retainer 92 has an annular lip 94 at a first end 96 thereof defining a stop at the first end and a plurality of vertical slots 98A–C evenly angularly spaced around the inner retainer corresponding in number to the number of vertical slots 90A–C in the tubular extension 88 on the plastic retainer 86.

The inner retainer 92 is connected to the tubular extension 88 by a plurality of small diameter elastic tubes 100A–C. Each of the elastic tubes 100A–C has a pair of flat pads 102A–B integrally joined thereto by a corresponding pair of radial webs 104A–B. The radial length dimensions of the webs 104A–B correspond, respectively, to the wall thicknesses of the tubular extension 88 and the inner retainer 92. The circumferential thickness dimensions of the webs 104A–B correspond, respectively, to the circumferential widths of the vertical slots 90A–C, 98A–C in the tubular extension 88 and the inner retainer 92. The longitudinal length dimensions of the webs 104A–B correspond to the lengths of the vertical slots 90A–C, 98A–C, respectively.

The elastic tubes 100A–C are mounted on the tubular extension 88 by squeezing the pads 102A through the vertical slots 90A–C until the webs 104A seat in the slots and are captured between the longitudinal ends thereof. The inner retainer 92 is connected to the elastic tubes 100A–C by squeezing the and the pads 102B through the vertical slots 98A–C until the webs 104B seat in the slots and are captured between the longitudinal ends thereof. Of course, where the vertical slots 90A–C, 98A–C are all the same size and the radial thicknesses of the tubular extension 88 and the inner retainer 92 are the same, the webs 104A–B fit in any of the vertical slots.

An electric fuel pump 48' includes a cylindrical housing 50', an inlet 52' at one end, and a discharge 54' at the other end. The pump 48' is disposed vertically in the inner retainer 92 with the inlet 52' projecting through the first end 96 of the inner retainer and through the bottom of the tubular extension 88 for attachment of a strainer corresponding to strainer 80. The stop defined by the lip 94 on the inner retainer prevents dislodgement of the fuel pump 48' through the first end 96 thereof. The pads 104B bear against the housing 50' of the fuel pump and define cushions between the fuel pump and the inner retainer 92, FIG. 5.

The diameter of each of the elastic tubes 100A–C is calculated to exceed the radial gap between the tubular extension 88 and the inner retainer 92 so that each of the elastic tubes is initially squeezed or flexed in a primary flexure mode along its full length, i.e. each of the elastic tubes assumes a generally oval-shaped cross section, FIG. 5, between the inner retainer 92 and the stationary support defined by the tubular extension 88. The primary flexure mode approximates simple beam bending of the wall of each elastic tube at each of a pair of diametrically opposite nodes 106A–B. As long as the walls of the elastic tubes do not buckle at the nodes 106A–B, such beam bending induces a plurality of resilient net force reactions between the inner retainer and the tubular extension 88 directed radially through the center of the inner retainer which cooperate in suspending the inner retainer and the fuel pump in radial static equilibrium in the center of the tubular extension.

When the electric motor of the fuel pump 48' is on, radial vibratory excursions of the fuel pump and the inner retainer 92 are resiliently resisted, i.e. isolated from the stationary support, by the elastic tubes 100A–C in the primary flexure mode through additional beam bending of the walls of the tubes at the nodes 106A–B. Non-radial excursions of the fuel pump relative to the stationary support are resiliently resisted by the elastic tubes 100A–C in a secondary flexure mode characterized by twisting and/or stretching of the tubes within the elastic limit of the material from which they are made.

We claim:

1. In a motor vehicle fuel system including a fuel tank and an electric fuel pump having a housing with a longitudinal centerline, a vibration isolating mounting for said fuel pump in said fuel tank comprising:

a stationary support in said fuel tank, a plurality of elastic tubes each having a tubular wall with a primary resilient flexure mode when said tubular wall is squeezed perpendicular a longitudinal centerline thereof characterized by beam bending of said tubular wall at each of a pair of diametrically opposite nodes of said tubular wall, and means mounting each of said elastic tubes parallel to said longitudinal centerline of said fuel pump housing between said fuel pump housing and said stationary support with said tubular wall of each of said elastic tubes squeezed perpendicular to said longitudinal centerline thereof in said primary flexure mode along the full length of said tubular wall thereby to exert on said fuel pump housing a resultant force directed radially relative to said longitudinal centerline of said fuel pump housing, said plurality of elastic tubes being arrayed around said fuel pump housing such that said radially directed resultant forces cooperate in suspending said fuel pump housing on said stationary support in radial static equilibrium.

2. The vibration isolating mounting recited in claim 1 wherein:

each of said tubular walls of said elastic tubes is a cylindrical wall.

3. The vibration isolating mounting recited in claim 2 wherein:

said stationary support is a reservoir in said fuel tank.

4. The vibration isolating mounting recited in claim 3 further comprising:

an elastic sleeve closely received on said fuel pump housing having each of said elastic tubes integral therewith.

5. The vibration isolating mounting recited in claim 4 wherein said means mounting each of said elastic tubes parallel to said longitudinal centerline of said fuel pump housing between said fuel pump housing and said stationary support includes:

a cylinder wall on said reservoir around said fuel pump housing and spaced therefrom by a predetermined radial clearance, and a plurality of open channels in said cylinder wall parallel to said longitudinal centerline of said fuel pump housing each receiving a respective one of said elastic tubes such that each of said elastic tubes is squeezed against the corresponding one of said open channels.

6. The vibration isolating mounting recited in claim 5 further comprising:

a shoulder at an end of each of said open channels, and an end on each of said elastic tubes engageable on said shoulder at said end of the corresponding one of said open channels to define an installed position of said fuel pump on said cylinder wall.

7. The vibration isolating mounting recited in claim 3 wherein said means mounting each of said elastic tubes parallel to said longitudinal centerline of said fuel pump housing between said fuel pump housing and said stationary support comprises:

a cylinder wall on said stationary support around said fuel pump, a tubular inner retainer between said cylinder wall and said fuel pump having a plurality of slots therein parallel to said longitudinal centerline of said fuel pump and evenly angularly spaced around said tubular inner retainer, a plurality of slots in said cylinder wall parallel to and corresponding in number to said plurality of slots in said tubular inner retainer and evenly angularly spaced around said cylinder wall, means supporting each of said elastic tubes in a respective one of said plurality of slots in said cylinder wall, and means supporting each of said elastic tubes in a respective one of said plurality of slots in said tubular inner retainer.

8. The vibration isolating mounting recited in claim 7 wherein:

said means supporting each of said elastic tubes in a respective one of said slots in said cylinder wall comprises:

a first radial web integral with said elastic tube closely fitted in said respective one of said slots in said cylinder wall, and a first flat pad integral with said first radial web on the opposite side of said cylinder wall from said elastic tube, and said means supporting each of said elastic tubes in a respective one of said slots in said tubular inner retainer comprises:

a second radial web integral with said elastic tube diametrically opposite said first radial web closely fitted in said respective one of said slots in said tubular inner retainer, and a second flat pad integral with said second radial web on the opposite side of said tubular inner retainer from said elastic tube.

* * * * *